US005261228A

United States Patent [19]

Shuba

[11] Patent Number: 5,261,228

[45] Date of Patent: Nov. 16, 1993

[54] APPARATUS FOR BLEEDING AIR

[75] Inventor: Brian H. Shuba, Mason, Ohio

[73] Assignee: General Electric Company, Cincinnati, Ohio

[21] Appl. No.: 904,302

[22] Filed: Jun. 25, 1992

[51] Int. Cl.[5] ..... F02C 6/18

[52] U.S. Cl. ..... 60/226.3; 60/226.3

[58] Field of Search ..... 60/226.3, 39.75–39.07, 60/262

[56] References Cited

U.S. PATENT DOCUMENTS

| | | | |
|---|---|---|---|
| 3,972,349 | 8/1976 | Tumavicus | 137/609 |
| 4,069,662 | 1/1978 | Redinger, Jr. et al. | 60/226 R |
| 4,304,093 | 8/1981 | Schulze | 60/39.07 |
| 4,329,114 | 5/1982 | Johnson et al. | 415/145 |
| 4,391,290 | 7/1983 | Williams | 60/39.75 |
| 4,463,552 | 8/1984 | Monhardt et al. | 60/226.1 |
| 4,493,184 | 1/1985 | Nikkanen et al. | 60/39.75 |
| 4,546,605 | 10/1985 | Mortimer et al. | 60/39.07 X |
| 4,715,779 | 12/1987 | Suciu | 60/39.07 |
| 4,849,895 | 7/1989 | Kervistin | 60/39.75 |
| 5,048,288 | 9/1991 | Bessette et al. | 60/226.1 |

*Primary Examiner*—Richard A. Bertsch
*Assistant Examiner*—Michael I. Kocharov
*Attorney, Agent, or Firm*—Jerome C. Squillaro

[57] ABSTRACT

A gas turbine engine includes a fan, fan bypass duct, compressor, core duct, and turbine including a clearance control system. The core duct includes a bleed valve, the fan bypass duct includes a bleed vent, and a bleed pipe is disposed in flow communication therebetween. A feed pipe is disposed in flow communication between the bleed pipe and the clearance control system. The apparatus is effective for practicing a method of bleeding a portion of compressed air from the core duct to the fan bypass duct during a first mode of operation, and diverting a portion of the bleed air from the bleed pipe into the feed pipe for flow to the clearance control system at a low flowrate during the first mode. During a second mode of operation, the method includes bleeding a portion of the fan air from the fan bypass duct and through the feed pipe to the clearance control system while discontinuing bleeding of the compressed air from the core duct. The bleed valve controls flow through the bleed pipe to both the fan bypass duct and the clearance control system for allowing flow therefrom during the first mode. And, during the second mode, the closed bleed valve allows bleeding of the fan air from the fan bypass duct automatically through the feed pipe to the clearance control system at the required increased flowrate.

7 Claims, 2 Drawing Sheets

APPARATUS FOR BLEEDING AIR

The present invention relates generally to gas turbine engines, and, more specifically, to bleed air and clearance control systems therein.

BACKGROUND OF THE INVENTION

A conventional turbofan gas turbine engine used for powering an aircraft in flight typically includes a variable bleed valve (VBV) system for controlling booster compressor stall margin, or includes a clearance control system surrounding a turbine for controlling blade tip clearances, or both. An exemplary turbofan engine includes in serial flow communication a fan, a booster compressor, a high pressure compressor (HPC), a combustor, a high pressure turbine (HPT), and a low pressure turbine (LPT), with the HPT driving the HPC, and the LPT driving both the fan and the booster compressor. The VBV system is disposed between the booster compressor and the HPC and includes selectively openable and closable bypass valves which are open during low power operation of the engine, such as at idle, for bleeding a portion of the compressed air into the fan bypass duct for controlling stall margin. The bleed valves are closed at high power operation of the engine, such as during cruise or takeoff, since bleeding is no longer required.

A typical clearance control system is an active system including a selectively variable modulating valve for controlling airflow to clearance control manifolds surrounding the turbine which selectively cool the turbine shrouds for minimizing blade tip clearances. In contrast to the VBV system, the clearance control system in this exemplary engine requires minimum airflow during low power operation of the engine, and maximum airflow during high power operation of the engine.

In both systems, the bleed valves and the modulating valves must be suitably actuated which increases the complexity of the engine.

SUMMARY OF THE INVENTION

A gas turbine engine includes a fan, fan bypass duct, compressor, core duct, and turbine including a clearance control system. The core duct includes a bleed valve, the fan bypass duct includes a bleed vent, and a bleed pipe is disposed in flow communication therebetween. A feed pipe is disposed in flow communication between the bleed pipe and the clearance control system. The apparatus is effective for practicing a method of bleeding a portion of compressed air from the core duct to the fan bypass duct during a first mode of operation, and diverting a portion of the bleed air from the bleed pipe into the feed pipe for flow to the clearance control system during the first mode. During a second mode of operation, the method includes bleeding a portion of the fan air from the fan bypass duct and through the feed pipe to the clearance control system while discontinuing bleeding of the compressed air from the core duct.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
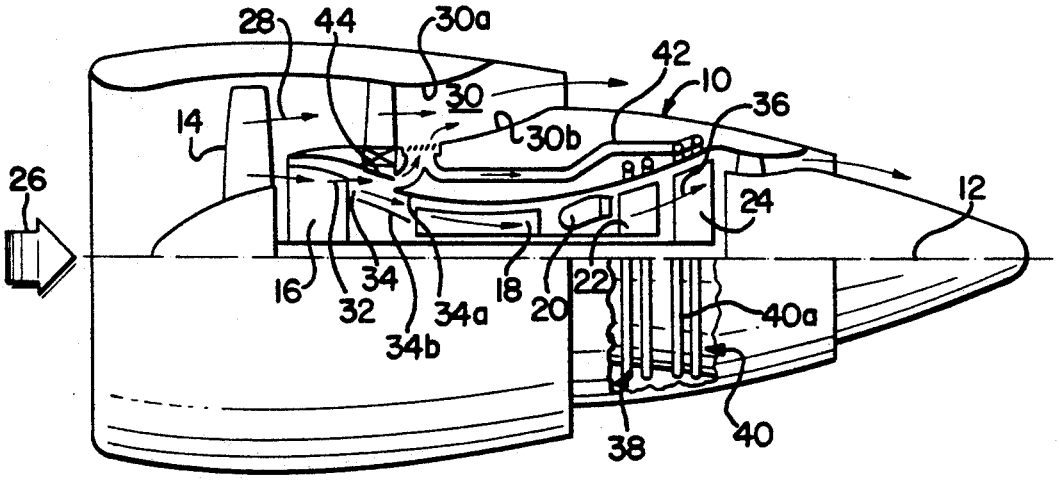
FIG. 1 is a schematic, axial, partly sectional view, of an exemplary turbofan gas turbine engine having a bleed and clearance control system in accordance with one embodiment of the present invention.

Illustrated in FIG. 1 is an exemplary turbofan gas turbine engine 10 having a longitudinal, axial centerline axis 12. The engine 10 includes in serial flow communication a fan 14, a low pressure or booster compressor (LPC) 16, a high pressure compressor (HPC) 18, a combustor 20, a high pressure turbine (HPT) 22, and a low pressure turbine (LPT) 24 all disposed coaxially about the centerline axis 12 and all being conventional. The HPT 22 conventionally drives the HPC 18, and the LPT 24 conventionally drives both the fan 14 and the LPC 16.

The fan 14 receives ambient air 26 and initially pressurizes it to form pressurized fan air 28. The fan 14 is disposed upstream of an annular fan bypass duct 30 through which is channeled an outer portion of the fan air 28, with an inner portion of the fan air 28 being channeled into the LPC 16. The bypass duct 30 includes radially spaced apart outer and inner annular walls **30*a* and 30*b***, respectively.

The fan air channeled into the LPC 16 is further compressed therein for forming compressed air 32 which is further channeled from the LPC 16 and through an annular compressor core duct 34 disposed downstream from the LPC 16 and upstream of the HPC 18. The core duct 34 includes radially outer and inner annular walls **34*a* and 34*b***, respectively.

The compressed air 32 is further compressed in the HPC 18 and is then channeled to the combustor 20 wherein it is conventionally mixed with fuel and ignited for generating combustion gases 36 which are channeled through the HPT 22 and the LPT 24 which extract energy therefrom. The HPT 22 is disposed directly downstream from the combustor 20 and includes a conventional active blade-tip clearance control system 38. The system 38 includes one or more annular tubes surrounding the outer casing of the HPT 22 and is provided with cooling airflow through a conventional modulating control valve (not shown) which selectively varies the amount of cooling air distributed by the tubes thereof for controlling clearance between the turbine blade tips and their surrounding shrouds.

The LPT 24 is disposed directly downstream of the HPT 22 and mediately downstream of the compressors 16 and 18 and includes a passive blade-tip clearance control system 40 provided with cooling airflow in accordance with one embodiment of the present invention. The clearance control system 40 itself is conventional and includes one or more annular tubes **40*a* surrounding the LPT 24 for impinging cooling air on the conventional shrouds surrounding the blade tips for controlling the clearances therebetween during operation of the engine 10. In accordance with one embodiment of the present invention, the system 40 receives cooling air through a feed pipe 42 which is characterized by the absence of a flow modulating valve unlike the active system 38 which includes a flow modulating valve. This may be accomplished by combining the clearance control system 40** with a variable bleed valve system for reducing the overall complexity of the two systems.

More specifically, the core duct 34 includes a plurality of selectivity openable and closable, conventional bleed valves 44 in its outer wall 34*a* disposed between the LPC 16 and the HPC 18. As shown in more particularity in FIG. 2, a representative one of the bleed valves 44 is hinged at its forward end so that its aft end may pivot away from the core duct 34 as shown in phantom line designated 44*a* in a fully open position for bleeding a portion of the compressed air 32 from the core duct 34 as bleed air designated 46. Means 48 are provided for selectively positioning the bleed valve 44 to its open position 44*a* shown in phantom line and to its closed position shown in solid line in FIG. 2. The bleed valve 44 and the positioning means 48 are conventional and may take any suitable form for selectively bleeding the compressed air 32. In one embodiment, there are ten bleed valves 44 circumferentially spaced apart from each other around the centerline axis 12.

In order to discharge the bleed air 46 from the core duct 34 and into the bypass duct 30, the bypass duct 30 includes a plurality of circumferentially spaced apart conventional bleed vents 50 disposed in the inner wall 30*b* thereof. Each of the bleed vents 50 includes a plurality of axially spaced apart conventional louvers 52 inclined in a downstream direction for injecting the bleed air 46 at an acute angle downstream into the bypass duct 30 for reducing mixing losses with the fan air 28. An annular manifold 54 is disposed below the several bleed vents 50 and in flow communication therewith for distributing the bleed air 46 from the several bleed valves 44 for more uniformly distributing the flow through the bleed vents 50. The manifold 54 may be fully annular in the form of a ring disposed coaxially about the centerline axis 12 or may include arcuate segments as desired.

A plurality of circumferentially spaced apart exhaust or bleed pipes 56 are disposed in flow communication with the respective bleed valves 46 and bleed vents 50 for channeling the bleed air 46 from the core duct 34 to the bleed vent 50 for discharge into the fan bypass duct 30 when the bleed valves 44 are open. In this exemplary embodiment, ten bleed pipes 56 are provided for the respective ten bleed valves 44 to collectively channel the bleed air 46 into the manifold 54 and in turn through the several bleed vents 50 into the bypass duct 30.

The operation of the bleed valves 44 is conventional for controlling stall margin of the LPC 16 during a first mode of operation of the engine 10 associated with low power, such as during ground idle or descent idle of the aircraft being powered by the engine 10. During such low power operation, it is desirable to bleed a portion of the compressed air 32 from the core duct 34 to the fan bypass duct 30 to increase compressor stall margin. And, during a second mode of operation of the engine 10 associated with relatively high power, such as during cruise or takeoff of the aircraft being powered by the engine 10, the bypass valves 44 are closed for discontinuing or stopping bleeding from the core duct 34 since it is no longer required.

Although the LPT clearance control system 40 illustrated in FIG. 1 requires minimum or low airflow therethrough during the first, idle mode of operation and maximum or high airflow therethrough during the second, cruise mode of operation, and the bleed system effects generally the opposite, i.e. maximum flow at the first, idle mode of operation and zero flow at the second, cruise mode of operation, it has been determined that the LPT clearance control system 40 may be combined with the bleed air system for an improved combination which will eliminate the need for an independent flow modulating valve for the LPT clearance control system 40.

Figure 2:
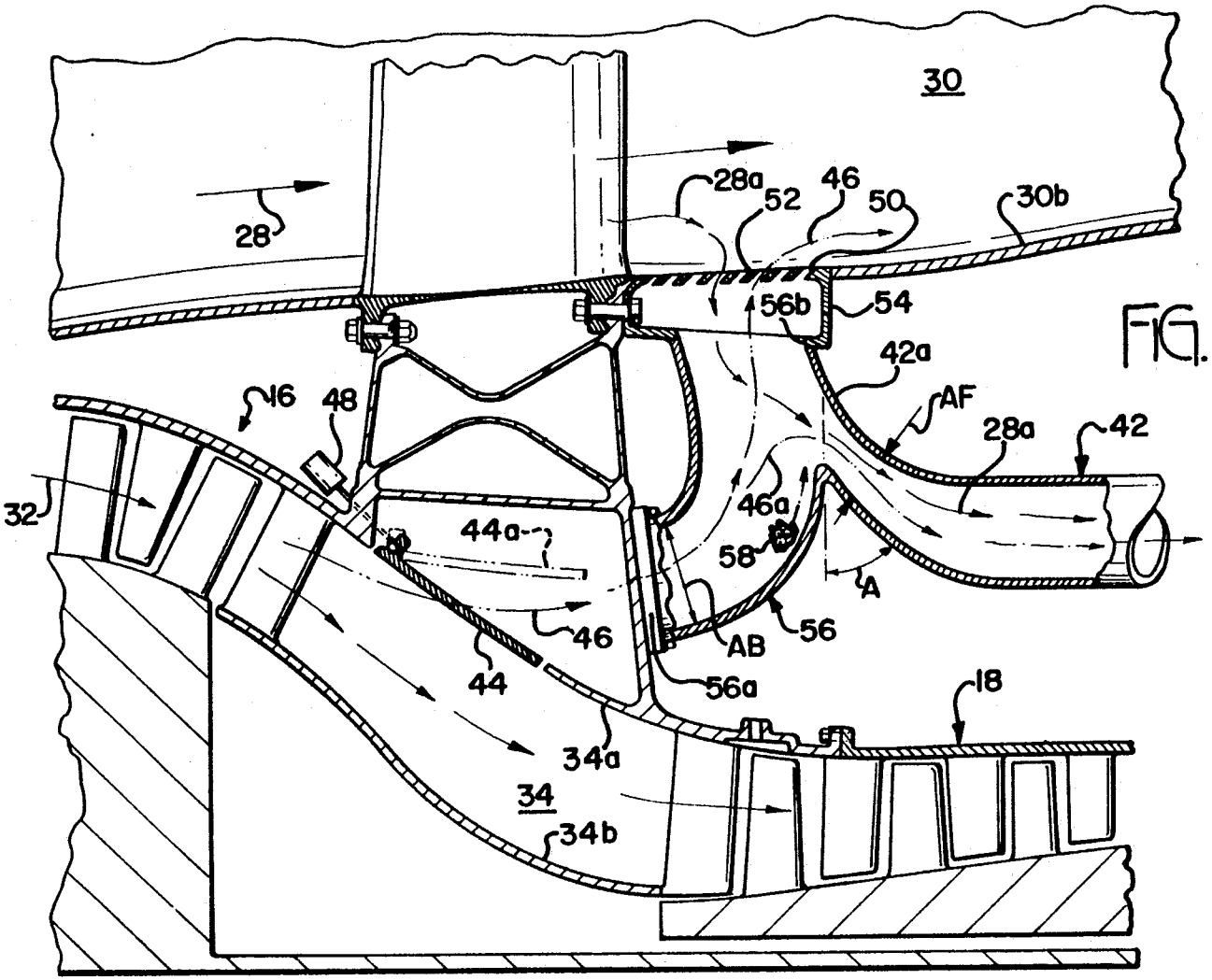
FIG. 2 is an enlarged, axial sectional view of a portion of the bleed and clearance control system illustrated in FIG. 1.

More specifically, and in accordance with one embodiment of the present invention, the feed pipe 42 is preferably disposed in flow communication between one of the bleed pipes 56 and the LPT clearance control system 40 for channeling a portion of the fan air, designated 28*a*, from the fan bypass duct 30 and through the bleed vent 50, manifold 54, and outer portion of the bleed pipe 46 to the LPT clearance control system 40 when the bleed valves 44 are closed. FIG. 2 illustrates the closed bleed valve 44 and the fan air portion 28*a* (both in solid line) being bled through the vents 50, into the feed pipe 42, and to the LPT clearance control system 40 when the bleed valves 44 are closed in the second, cruise mode of operation of the engine 10. In this way, the pressurized fan air portion 28*a* is provided through the feed pipe 42 to the LPT clearance control system 40 for conventionally selectively cooling the shrouds of the LPT 24 during the second, cruise mode of operation which requires the maximum flowrate through the clearance control system 40.

During the first, idle mode of operation, the bleed valves 44 are conventionally opened by the positioning means 48 to their fully opened position as shown in phantom line in FIG. 2, and the bleed air 46, also shown in phantom line, is channeled through the opened valves 44 and the bleed pipes 56 to the manifold 54 and through the vents 50 into the fan bypass duct 30. However, a portion of the bleed air 46, designated 46*a*, is diverted in the one bleed pipe 56 from flowing to the fan bypass duct 30 and instead in channeled through the feed pipe 42 to the LPT clearance control system 40 during the idle mode. In this way, the LPT clearance control system 40 may be passive without the need for a dedicated flow modulating valve therefor, and the feed pipe 42 is characterized by the absence of a flow modulating valve between the bleed pipe 56 and the LPT clearance control system 40, with flow through the feed pipe 42 being modulated solely by positioning of the bleed valve 44 associated with the bleed pipe 56 to which the feed pipe 42 is joined.

In the idle mode, the bleed valves 44 are open (44*a*) for providing maximum flow of the bleed air 46 into the bypass duct 30. And, a predetermined, relatively small portion thereof, i.e. 46*a*, flows through the feed pipe 42 to the clearance control system 40 for providing it with its required low flowrate.

During the cruise mode, the bleed valves 44 are closed and thusly block flow of the compressed air 32 from the core duct 34 to both the bypass duct 30 and the feed pipe 42. The relatively high flowrate of air required for the clearance control system 40 during the cruise mode is instead provided directly from the bypass duct 30 by bleeding the fan air portion 28*a* therefrom through the vent 50 and into the feed pipe 42 while discontinuing bleeding of the compressed air 32 from the core duct 34, which is required only for the idle mode of operation.

In this exemplary and preferred embodiment of the invention, the bleed vents 50 are fixed in size and are ineffective for modulating flow therethrough. The louvers 52 are also fixed and inclined rearwardly for more efficiently injecting the bleed air 46 into the bypass duct 30 during the idle mode. In an alternate embodiment, the louvers 52 could be adjustable for reversing their inclination to a forward direction during the cruise mode for more efficiently capturing the fan air portion 28a into the manifold 54 if desired. However, flow out or in through the vents 50 is controlled solely by the bleed valves 44, and the vents 50 are, therefore, unobstructed by any flow modulating structure.

As mentioned above, the airflow requirements of the bleed valve system and the LPT clearance control system 40 are different and generally opposite. The compressed air 32 upon being compressed in the LPC 16 is at a higher pressure than that of the fan air 28 being channeled through the bypass duct 30. Accordingly, when the bleed valves 44 are fully open (44a) the bleed air 46 is caused to flow by the pressure differential therebetween through the bleed pipes 56 and into the bypass duct 30. Each of the bleed pipes 56 has a predetermined flow area designated AB for collectively channeling the required amount of bleed air 46 therethrough during the idle mode for improving booster compressor stall margin. During the cruise mode of operation, the bleed valves 44 are closed and no bleed air 46 is channeled through the pipes 56 to the bypass duct 30.

However, and conversely to the bleed valve system, the LPT clearance control system 40 requires its maximum flowrate during the cruise mode when the bleed valves 44 are closed, and requires its minimum flowrate when the bleed valves 44 are open. The maximum, or second, flowrate is preselected for each design application, and the minimum, or first, flowrate is suitably less than the second flowrate, i.e. the second flowrate is greater than the first flowrate. Since both the bleed air portion 46a and the fan air portion 28a are bled or diverted as portions from the respective bleed air 46 and the fan air 28 through the common feed pipe 42, and since the feed pipe 42 does not include a flow modulating valve therein, the feed pipe 42 is preferably sized and configured for channeling the bleed air portion 46a at the first flowrate when the bleed valve 44 is opened, and for channeling the fan air portion 28a at the second flowrate when the bleed valve 44 is closed.

More specifically, the bleed pipe 56 joined to the feed pipe 42 is preferably arcuate in axial section in FIG. 2, and in the exemplary form of an elbow extending over a range of about 90°, and includes a first port, or inlet 56a at its proximal end joined in flow communication with a respective one of the bleed valves 44. The bleed pipe 56 also includes a second port, or outlet, 56b at its distal end joined in flow communication with the manifold 54 and in turn with the bleed vents 50. The feed pipe 42 includes a proximal end portion or inlet 42a joined in flow communication with the bleed pipe 56 at an acute inclination angle A relative thereto. The angle A may be about 40°, for example, and the resulting juncture of the bleed pipe 56 and the feed pipe 42 form a generally Y-configuration. In this configuration, the feed pipe 42 is preferably inclined toward the second port 56b in general line-of-sight therewith and away from the first port 56a to block line-of-sight therewith in a serpentine flowpath fashion. Also in the preferred embodiment, the second port 56b is preferably disposed radially above the first port 46a so that the bleed pipe 54 is effective for turning and channeling upwardly the bleed air 46 when the bleed valves 44 are open. And, the feed pipe 42 at its inlet end 42a is preferably joined adjacent to the second port 56b and closer thereto than to the first port 56a, with the feed pipe inlet 42a being inclined radially inwardly from the bleed pipe 56 at the inclination angle A.

With this configuration, the feed pipe 42 is effective for receiving the fan air portion 28a from the bleed vent 50 and second port 56b without obstruction or significant pressure losses when the corresponding bleed valve 44 is closed, and is also effective for receiving the bleed air portion 46a from the bleed valve 44 and first port 56a with pressure reducing restriction or obstruction when the bleed valve 44 is open. More specifically, the feed pipe inlet 42a has a flow area AF preselected for providing the required second, maximum flowrate of the fan air portion 28a from the first port 56b into the LPT clearance control system 40 when the bleed valves 44 are closed. The second, or maximum flowrate for the fan air portion 28a channeled through the feed pipe 42 is substantially lower than the flowrate of the bleed air 46 channeled through each bleed pipe 56 when the bleed valves 44 are open, and for example, is about one quarter the amount thereof. By aligning the feed pipe inlet 42a as described above for directly receiving the fan air portion 28a during the cruise mode, the fan air portion 28a is provided at the required relatively high second flowrate through the feed pipe inlet 42a without significant pressure losses therein.

However, since the flow area AF of the feed pipe inlet 42a is fixed, and since the pressure of the bleed air 46 is greater than the pressure of the fan air 28, the above described configuration will introduce pressure losses into the bleed air portion 46a for obtaining the relatively low first flowrate required to be channeled through the feed pipe 42 during the idle mode of operation. Since the bleed air portion 46a as illustrated in FIG. 2 must flow in a serpentine fashion and change its direction from generally radially upwardly through the feed pipe 56 to generally radially downwardly into the feed pipe inlet 42a, pressure losses are necessarily generated therein for reducing its flowrate.

Accordingly, the configuration illustrated, is effective for introducing pressure losses in the bleed air portion 46a during the idle mode which are significantly greater than the pressure losses in the fan air portion 28a during the cruise mode. In this way, the common feed pipe 42 without its own conventional modulating flow valve as typically provided in an active clearance control system, may be used in combination with the bleed valve system for selectively and alternatively receiving either a portion of the bleed air 46 from the core duct 34 or a portion of the fan air 28 from the bypass duct 30 at the required different flowrates for effective operation of the LPT clearance control system 40. The bypass valve 44 itself is used directly for controlling the bleed valve system and indirectly for controlling the LPT clearance control system 40 which, therefore, eliminates the requirement for an independent flow modulating valve for the latter.

An additional advantage of utilizing the arcuate bleed pipe 56 having the feed pipe 42 joined to its radially outer end, is the reduction or elimination of ice ingestion into the LPT clearance control system 40 which could adversely affect its heat transfer capability. An exemplary piece of ice 58 is shown inside one of the bleed pipes 56 which may find its way therein during idle operation of the engine 10 during aircraft descent when the bleed valves 44 are open. The ice 58 may be ingested into the engine 10 and flow past the fan 14 and through the LPC 16 from which it is captured by an open bleed valve 44 and ingested into a bleed pipe 56. The ice 58 will tend to travel along the arcuate bleed pipe 56 and will be traveling generally radially upwardly as it reaches the feed pipe inlet 42*a* joined thereto. Since the inertia of the ice 58 is substantially greater than the inertia of the bleed air 46, it will separate from the bleed air portion 46*a* being diverted into the feed pipe 42, and thus the likelihood of the ice 58 entering the feed pipe 42 is reduced or eliminated.

The preferred configuration of the combined bleed pipe 56 and feed pipe 42 thusly allows for two different flowrates through the feed pipe 42 utilizing two different sources of air, i.e. the fan air 28 and the compressed air 32. These two different flowrates may be effectively utilized in the LPT clearance control system 40 since further modulation thereof is not ordinarily required. However, the HPT clearance control system 38 typically requires a larger and typically infinitely variable flowrate therethrough, and, therefore, the above configuration would ordinarily not be beneficial therewith. Instead, the HPT clearance control system 38 will ordinarily use a conventional flow modulating valve in an active configuration for providing the required variations of flowrate.

While there have been described herein what are considered to be preferred embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

I claim:

1. An apparatus for channeling air in a gas turbine engine comprising:

a fan disposed upstream of a fan bypass duct for channeling fan air therethrough, said fan bypass duct including a bleed vent;

a compressor disposed downstream of said fan for receiving therefrom a portion of said fan air, said fan air portion being compressed therein for forming compressed air channeled through a core duct disposed downstream of said compressor, said core duct including a selectively openable and closable bleed valve;

a turbine disposed downstream of said compressor, and including a clearance control system;

a bleed pipe disposed in flow communication between said bleed valve and said bleed vent for bleeding a portion of said compressed air as bleed air from said core duct to said bleed vent for discharge into said fan bypass duct when said bleed valve is open; and a feed pipe disposed in flow communication between said bleed pipe and said clearance control system, and characterized by the absence of a flow modulating valve therebetween, flow through said feed pipe being modulated by positioning of said bleed valve for channeling a portion of said fan air from said fan bypass duct and through said bleed vent to said clearance control system when said bleed valve is closed, and for channeling a portion of said bleed air from said core duct and through said bleed pipe to said clearance control system when said bleed valve is open.

2. An apparatus according to claim 1 wherein said feed pipe includes an inlet joined in flow communication with said bleed pipe at an acute angle thereto.

3. An apparatus according to claim 2 wherein:

said bleed pipe includes a first port at a proximal end thereof joined in flow communication with said bleed valve, and a second port at a distal end thereof joined in flow communication with said bleed vent; and said feed pipe is inclined toward said second port and away from said first port for receiving said fan air portion from said second port when said bleed valve is closed, and for receiving a portion of said bleed air from said first port when said bleed valve is open.

4. An apparatus according to claim 3 wherein:

said bleed pipe is arcuate in axial section;

said second port is disposed radially above said first port;

said feed pipe is joined to said bleed pipe adjacent to said second port; and said feed pipe is inclined radially inwardly from said bleed pipe.

5. An apparatus according to claim 4 wherein:

said clearance control system is operable at first and second flowrates, with said second flowrate being greater than said first flowrate; and said feed pipe is sized and configured for channeling said bleed air portion from said first port at said first flowrate when said bleed valve is open, and for channeling said fan air portion from said second port at said second flowrate when said bleed valve is closed.

6. An apparatus according to claim 5 wherein said feed pipe is inclined toward said second port in general line-of-sight therewith and away from said first port to block line-of-sight therewith.

7. An apparatus according to claim 5 wherein said feed pipe has an inlet joined in flow communication with said bleed pipe and having a flow area preselected for providing said second flowrate when said bleed valve is closed.

* * * * *